US005738046A

United States Patent [19]

Williams et al.

[11] Patent Number: 5,738,046

[45] Date of Patent: Apr. 14, 1998

[54] SAFETY JACKET AND HARNESS SYSTEM

[76] Inventors: Tommie Ann Williams; David A. Williams, both of 4474 County Rd. 30, Clanton, Ala. 35045

[21] Appl. No.: 695,682

[22] Filed: Jul. 22, 1996

[51] Int. Cl.[6] ..... A62B 35/00

[52] U.S. Cl. ..... 119/770; 182/3; 182/9; 2/94; 2/108; 119/798; 119/907; 119/797

[58] Field of Search ..... 119/770, 857, 119/797, 798, 795, 792, 793, 907; 182/3, 9; 2/94, 108

[56] References Cited

U.S. PATENT DOCUMENTS

| | | | |
|---|---|---|---|
| 1,738,581 | 12/1929 | Hodgson | 119/770 |
| 2,568,304 | 9/1951 | Schoenbrun | 119/770 |
| 3,444,957 | 5/1969 | Ervin, Jr. | 182/3 |
| 3,701,395 | 10/1972 | Theobald | 182/3 |
| 4,273,215 | 6/1981 | Leggett | 119/857 |
| 4,446,944 | 5/1984 | Forrest et al. | 182/3 |
| 4,774,801 | 10/1988 | Johansen et al. | 119/797 |

FOREIGN PATENT DOCUMENTS

| | | | |
|---|---|---|---|
| 32 22 225 A1 | 12/1983 | Germany | 2/94 |
| 94/21328 | 9/1994 | WIPO | 182/3 |

*Primary Examiner*—Edgar S. Burr
*Assistant Examiner*—Leslie J. Grohusky

[57] ABSTRACT

A safety jacket and harness system including a body harness formed by a pair of torso bands and a pair of shoulder straps. The torso bands form an upper torso band and a lower torso band. Each torso band has a fastening member that is attached to end portions. The pair of shoulder straps each have a first shoulder strap portion and a second shoulder strap portion. Each shoulder strap portion is coupled together by a fastening member when each shoulder strap is attached to the pair of torso bands. Included is a center strap that is fixedly attached to the pair of torso bands and has a locking member at a top end. A safety strap has a first safety strap end that can couple with the locking member of the center strap, and a second safety strap end that can be looped and fastened around a tree trunk. An escape strap is attached to the safety strap. Lastly, a jacket receives the body harness when worn by a hunter using a tree stand with the center strap of the harness coupled to the safety strap looped around the tree trunk.

10 Claims, 4 Drawing Sheets

SAFETY JACKET AND HARNESS SYSTEM

BACKGROUND OF THE INVENTION

1. Field of the Invention

The present invention relates to a safety jacket and harness system and more particularly pertains to providing a safety system for the user of a tree stand and the system has a jacket coupled with a body harness that is fastened to a safety strap looped around the tree trunk.

2. Description of the Prior Art

The use of a safety jacket is known in the prior art. More specifically, safety jackets heretofore devised and utilized for the purpose of anchoring the wearer incase of losing their footing are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,273,216 to Weissmann discloses a safety jacket. U.S. Pat. No. 4,682,671 to Hengstenberger, Montavon and Fuller discloses a safety harness. U.S. Pat. No. 4,076,101 to Himmelrich discloses a utility coat with seating harness. U.S. Pat. No. 4,177,877 to Gallinati discloses a safety vest. U.S. Pat. No. 3,973,643 to Hutchinson discloses a detachable harness for fireman's coat and the like. Lastly, U.S. Pat. No. Des. 261,070 to Pettibone discloses a field and winter sports jacket.

While these devices fulfill their respective, particular objectives and requirements, the aforementioned patents do not describe safety jacket and harness system that allows a hunter using a tree stand to have a safety system that breaks the hunter's fall and gives the hunter an easy way to lower himself down after the fall.

In this respect, the safety jacket and harness system according to the present invention substantially departs from the conventional concepts and designs of the prior art, and in doing so provides an apparatus primarily developed for the purpose of providing a safety system for the user of a tree stand and the system has a jacket coupled with a body harness that is fastened to a safety strap looped around the tree trunk.

Therefore, it can be appreciated that there exists a continuing need for a new and improved safety jacket and harness system which can be used for providing a safety system for the user of a tree stand and the system has a jacket coupled with a body harness that is fastened to a safety strap looped around the tree trunk. In this regard, the present invention substantially fulfills this need.

SUMMARY OF THE INVENTION

In view of the foregoing disadvantages inherent in the known types of safety jackets now present in the prior art, the present invention provides an improved safety jacket and harness system. As such, the general purpose of the present invention, which will be described subsequently in greater detail, is to provide a new and improved safety jacket and harness system and method which has all the advantages of the prior art and none of the disadvantages.

To attain this, the present invention essentially comprises a body harness being formed by a pair of torso bands and a pair of shoulder straps. The torso bands form an upper torso band and a lower torso band. Each torso band has a fastening member that is attached to end portions. Each shoulder strap has a first shoulder strap portion and a second shoulder strap portion. The first shoulder strap portion of each shoulder strap is fixedly attached to a rear side of the upper torso band and looped over a rear side of the lower torso band for permanent attachment. The second shoulder strap portion of each shoulder strap is fixedly attached to a front side of the upper torso band and looped over a front side of the lower torso band for permanent attachment. The first shoulder strap portion and the second shoulder strap portion, of each shoulder strap, is capable of being coupled together by a fastening member when each shoulder strap is attached to the pair of torso bands. A center strap is fixedly attached to the rear side of the pair of torso bands. The center strap has a connection loop with a locking member at a top end. Also, a linearly extending safety strap has a first safety strap end capable of coupling with the locking member of the connection loop of the center strap. The safety strap has a second safety strap end that can be looped around a tree trunk. The second safety strap end has a locking member for coupling with a slip ring of the safety strap, when positioned around the tree trunk. Included is a tension strap that is fixedly attached to the safety strap and housed within a pouch. The tension strap is capable of coupling with the slip ring positioned around the safety strap, when the second end of the safety strap is looped around the tree trunk and coupled to the slip ring. An elongated escape strap is fixedly attached to the safety strap and spaced from the first safety strap end. The escape strap is folded and positioned within a holder attached to the safety strap. Lastly, a jacket receives the body harness when worn by a hunter using a tree stand. The jacket has a pair of shoulder flaps, a pair of under arm flaps and a pair of waist flaps. Each of the flaps have one end fixedly attached to the jacket and another end with a snap-type fastener member. One of each of the shoulder flaps is capable of securing the first shoulder strap portion of the harness. The upper torso band is supported about the jacket with the pair of under arm flaps. The lower torso band is supported about the jacket with the pair of under arm flaps. The center strap of the harness is coupled to the safety strap looped around the tree trunk, when the jacket is worn by the hunter, to support the hunter in the invent of being separated from the tree stand.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved safety jacket and harness system which has all of the advantages of the prior art safety jackets and none of the disadvantages.

It is another object of the present invention to provide a new and improved safety jacket and harness system which may be easily and efficiently manufactured and marketed.

It is further object of the present invention to provide a new and improved safety jacket and harness system which is of durable and reliable constructions.

An even further object of the present invention is to provide a new and improved Safety jacket and harness system which is susceptible of a low cost of manufacture with regard to both materials and labor, and which accordingly is then susceptible of low prices of sale to the consuming public, thereby making such Safety jacket and harness system economically available to the buying public.

Even still another object of the present invention is to provide an improved safety jacket and harness system for providing a safety system for the user of a tree stand and the system has a jacket coupled with a body harness that is fastened to a safety strap looped around the tree trunk.

Lastly, it is an object of the present invention to provide a new and improved safety jacket and harness system including a body harness formed by a pair of torso bands and a pair of shoulder straps. The torso bands form an upper torso band and a lower torso band. Each torso band has a fastening member that is attached to end portions. The pair of shoulder straps each have a first shoulder strap portion and a second shoulder strap portion. Each shoulder strap portion is coupled together by a fastening member when each shoulder strap is attached to the pair of torso bands. Included is a center strap that is fixedly attached to the pair of torso bands and has a locking member at a top end. A safety strap has a first safety strap end that can couple with the locking member of the center strap, and a second safety strap end that can be looped and fastened around a tree trunk. An escape strap is attached to the safety strap. Lastly, a jacket receives the body harness when worn by a hunter using a tree stand with the center strap of the harness coupled to the safety strap looped around the tree trunk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
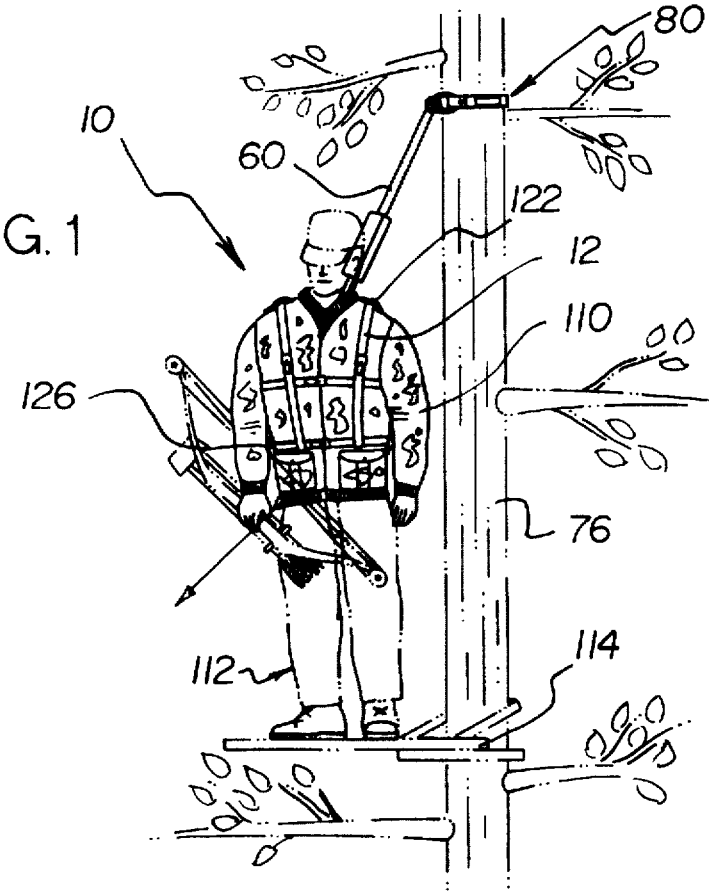
FIG. 1 is a perspective view of the preferred embodiment of the safety jacket and harness system constructed in accordance with the principles of the present invention.

With reference now to the drawings, and in particular to FIG. 1 thereof, the preferred embodiment of the new and improved safety jacket and harness system embodying the principles and concepts of the present invention and generally designated by the reference numeral 10 will be described.

The present invention, the safety jacket and harness system 10 is comprised of a plurality of components. Such components in their broadest context include a jacket, a body harness, and a safety strap. Such components are individually configured and correlated with respect to each other so as to attain the desired objective.

Figure 2:
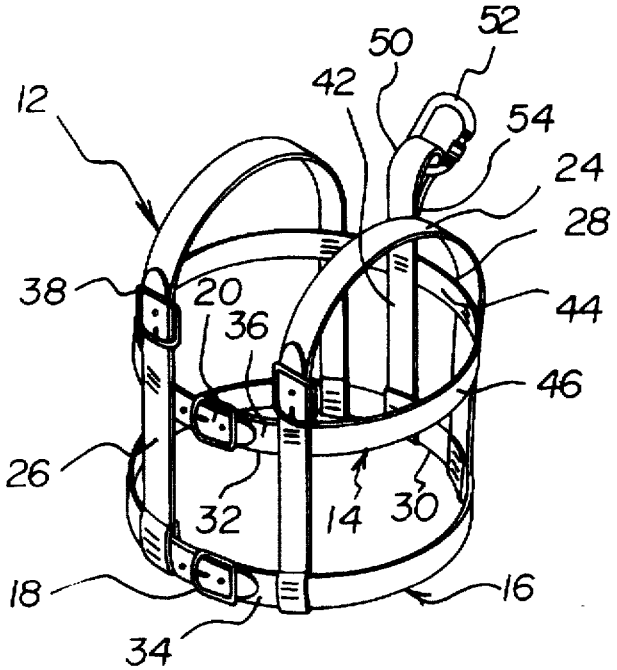
FIG. 2 is an isometric view of the body harness of the present invention.

Specifically, the present invention includes a body harness 12 that is formed by a pair of torso bands and a pair of shoulder straps. The harness is webbed material such as nylon of other similar fabric. The torso bands form an upper torso band 14 and a lower torso band 16. Each torso band has a fastening member 18 for coupling to end portions 20, as seen in FIG. 2. The fastening member of the present invention is a buckle. The upper and lower torso bands, when buckled together, will completely encircle the torso. The upper torso band will encircle the chest area. The lower torso band will encircle the upper body section just above the waist of the user.

Each shoulder strap has a first shoulder strap portion 24 and a second shoulder strap portion 26. The first shoulder strap portion of each shoulder strap is fixedly attached to a rear side 28 of the upper torso band and is looped over a rear side 30 of the lower torso band for permanent attachment. The second shoulder strap portion 26 of each shoulder strap is fixedly attached to a front side 32 of the upper torso band and is looped over a front side 34 of the lower torso band for permanent attachment. The second shoulder strap portion is attached to the exterior 36 of the front side of the upper torso band.

Attaching the second shoulder strap portion in this manner prevents the second shoulder strap portion from being easily detached from the upper band when the harness is in use. The first shoulder strap portion and the second shoulder strap portion, of each shoulder strap, are coupled together by a fastening member 38 when each shoulder strap is attached to the pair of torso bands. The fastener member of the shoulder straps is a buckle identical to the buckles of the torso bands.

Also, a center strap 42 is fixedly attached to the rear side, 28 and 30, of the pair of torso bands. The center strap is fastened to the interior 44 of the upper band, while the first shoulder strap portion of each shoulder strap is attached to the exterior 46 of the upper torso band. Attaching the center straps and shoulder straps in this alternating manner, reduces the strain along the rear side of the upper band. In the event the body harness is in use, the pulling forces, on the rear side, are equalized in both directions. The center strap, as seen in FIG. 2, has a connection loop 50 with a locking member 52 at a top end 54.

Figure 3:
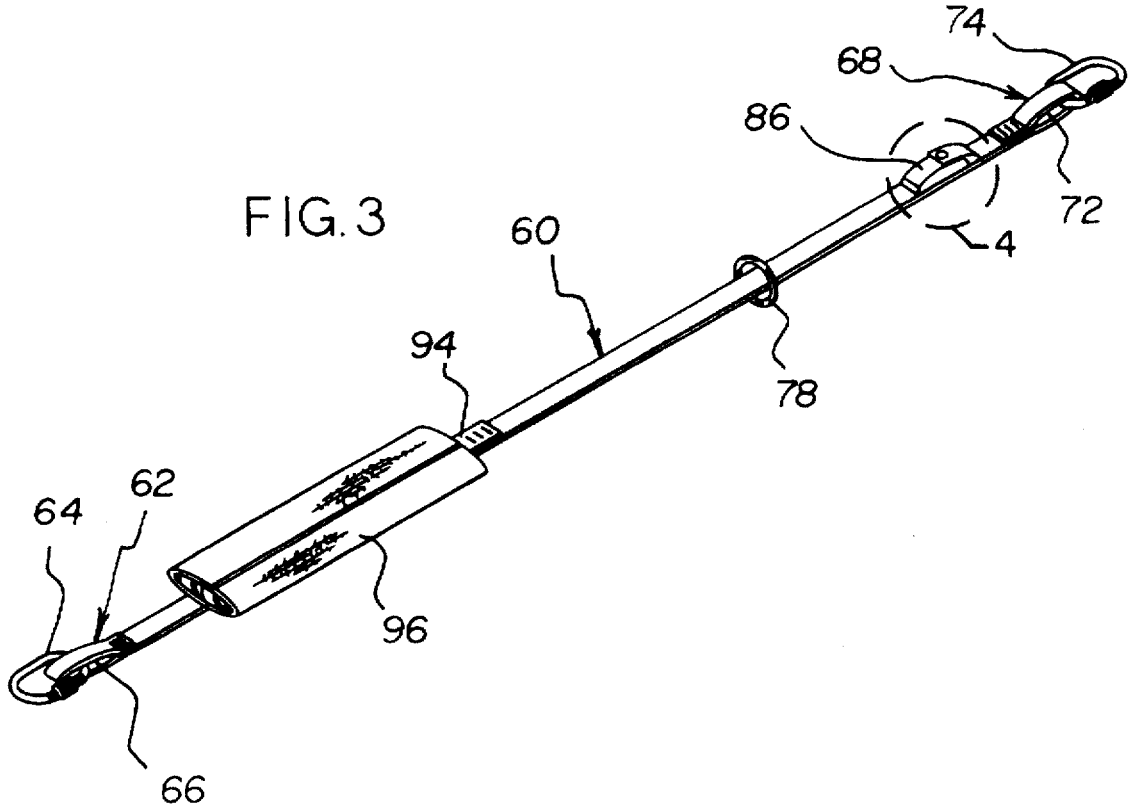
FIG. 3 is an isometric view of the safety strap of the present invention.

Included is a linearly extending safety strap 60 that is formed of webbed material. The safety strap, as shown in FIG. 3, has a first safety strap end 62 that is capable of coupling with the locking member 52 of the connection loop of the center strap. The locking member of the center strap couples with a locking member 64 secured over a loop 66 of the first safety strap end. The safety strap has a second safety strap end 68 that has a loop 72 with a locking member 74 coupled. The second safety strap end is capable of being looped around a tree trunk 76, as seen in FIG. 1. When the second safety strap end is looped around the tree the locking member 74 couples with a slip ring 78 of the safety strap. That portion of the safety strap, when looped around the tree trunk, forms a harness anchor 80.

Figure 4:
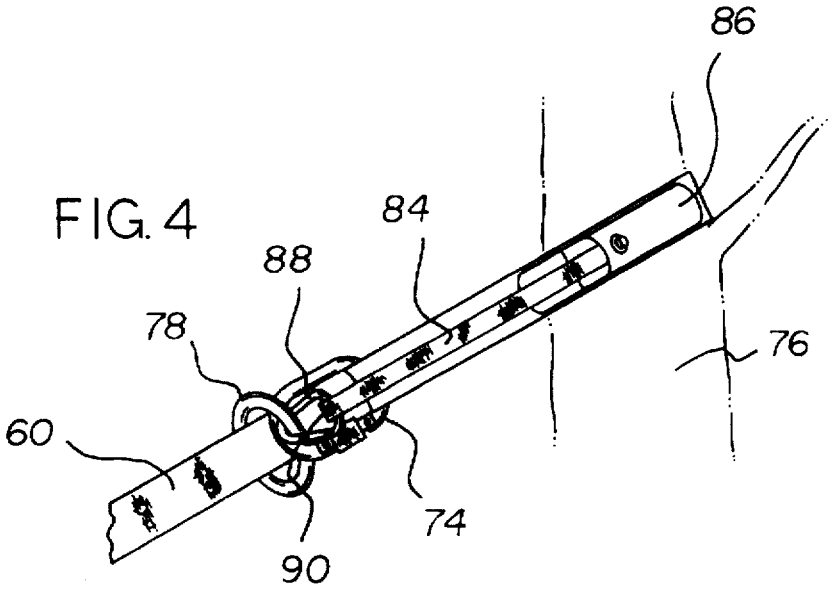
FIG. 4 is an isometric view of the tension strap of the present invention in an operable orientation.

Additionally, a tension strap 84 is fixedly attached to the safety strap near the second safety strap end 68. As shown in FIG. 3, the tension strap is housed within a pouch 86. The tension strap is formed of an elastic material and is extendable from the pouch when needed. As seen in FIG. 4, the tension strap has a triangular clip member 88 coupled to an end 90. The tension strap may be coupled with the slip ring, of the safety strap, when the second end of the safety strap is looped around the tree trunk and coupled to the slip ring. The tension strap is used to tighten the harness anchor when it is positioned around the tree trunk. The tension strap is most useful on slick or hard barked tree trunks.

The locking members set forth above are identical. Locking members 52, 64, and 74 are oval shaped aluminum carabiner. Each locking member is capable of supporting weights up to 4,500 lbs.

Figure 5:
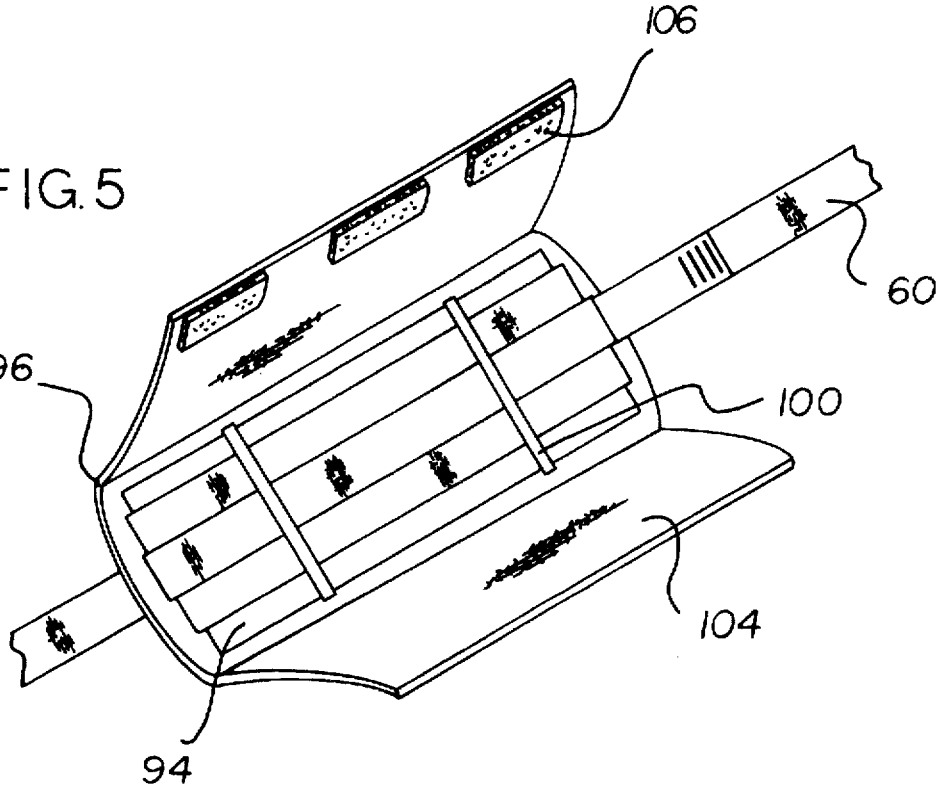
FIG. 5 is an isometric view of the escape strap in the holder of the present invention in a stored orientation.
Figure 6:
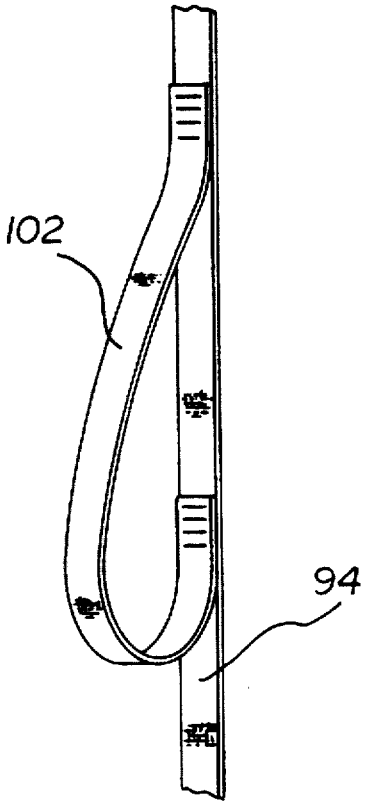
FIG. 6 is an isometric view of the stirrup of the escape strap of FIG. 5.
Figure 7:
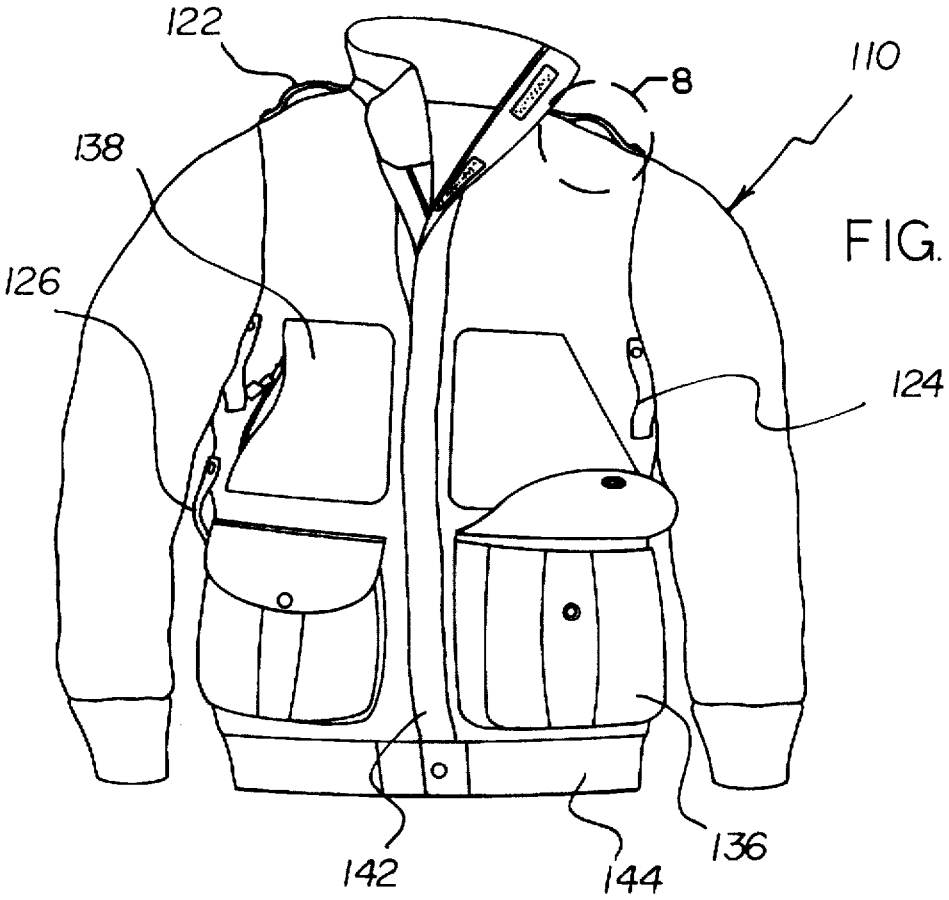
FIG. 7 is a frontal view of the jacket of the present invention.

Opposite the tension strap is an elongated escape strap 94. The escape strap is fixedly attached to the safety strap and spaced from the first safety strap end 62. The escape strap is used after the body harness has stopped the initial fall of the user of the invention. The escape strap, as shown in FIG. 5, is folded and positioned within a holder 96. The holder is attached to the safety strap. The escape strap is about thirty feet in length and can be extended from the safety strap to hang freely. The escape strap, when folded and laid within the holder, is secured within by at least two rubber bands 100. The escape strap, also has a stirrup 102 attached midway the escape strap. The stirrup, of FIG. 6, is used by the foot of the user to support the user in the event the escape is used. The holder has closure members 104 that fold one over the other. The closure members are secured with a plurality of pile-type fasteners 106.

Figure 8:
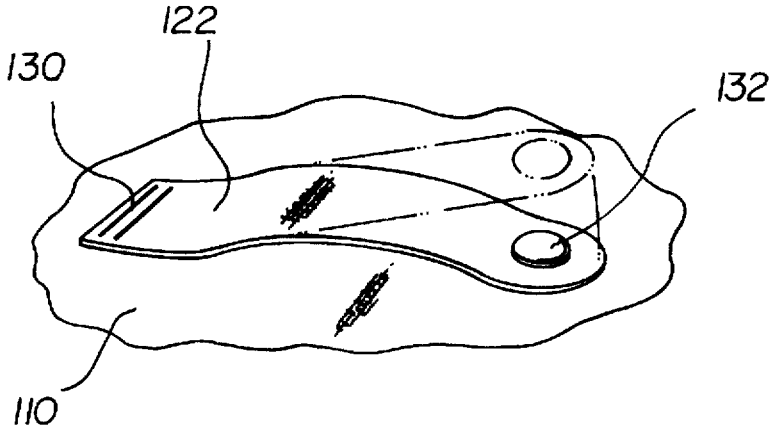
FIG. 8 is an enlarged view of a flap of the jacket of the present invention taken at position 8 of FIG. 7.

Lastly, a jacket 110 receives the body harness 12 when worn by a hunter 112 using a tree stand 114. The jacket has a pair of shoulder flaps 122, a pair of under arm flaps 124 and a pair of waist flaps 126. As depicted in FIG. 8, each of the flaps have one end 130 fixedly attached to the jacket and another end 132 with a snap-type fastener member. The flaps are not limited to having snap fasteners, pile-type fastener member could be used. FIG. 1 shows, that one of each of the shoulder flaps is capable of securing the first shoulder strap portion of the harness. The upper torso band is supported about the jacket with the pair of under arm flaps. The lower torso band is supported about the jacket with the pair of under arm flaps. The center strap of the harness is coupled to the safety strap looped around the tree trunk when the jacket is worn by the hunter to support the hunter in the invent of being separated from the tree stand.

Furthermore, two wide pockets 136 are added to the jacket in addition to the normal pair of jacket pockets 138. Each wide pocket is positioned adjacent the fastening juncture 142 of the jacket 110 and the waist band 144. The wide pockets extend toward the back of the jacket. The wide pockets are used to store the safety strap while not in use.

The safety jacket and harness system of the present invention is a treestand safety system structured to make the use of a safety harness both easy and convenient. The present invention includes a hunting jacket with flaps for capturing the shoulder straps and torso bands of the body harness. The body harness is hooked onto a safety strap when the hunter is positioned on the tree stand. The safety strap is fastened around the tree trunk, either adjacent the tree stand or above the tree stand. The safety strap will prevent the hunter from falling to the ground if he slips from the tree stand.

Once the hunter is supported by the safety strap during the initial fall, an escape strap is provided. The escape strap is attached to the safety strap. The hunter removes the escape strap from its holder and allow the escape strap to extend vertically. Attached to the safety strap is a stirrup. The hunter may use the escape strap to pull himself up back into the stand or lower himself to the ground. The stirrup receives the hunters foot as he dangles from the safety strap. The stirrup gives the hunter added support while using the escape strap. The hunter, when using the escape strap, has the ability to unfasten the body harness from the jacket and lowering himself to the ground.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved safety jacket and harness system for use by a hunter perched on a tree stand comprising in combination:

a body harness being formed by a pair of torso bands and a pair of shoulder straps, the torso bands forming an upper torso band and a lower torso band, each torso band having a fastening member being attached to end portions thereof, each shoulder strap having a first shoulder strap portion and a second shoulder strap portion, the first shoulder strap portion of each shoulder strap being fixedly attached to a rear side of the upper torso band and looped over a rear side of the lower torso band for permanent attachment thereto, the second shoulder strap portion of each shoulder strap being fixedly attached to a front side of the upper torso band and looped over a front side of the lower torso band for permanent attachment thereto, the first shoulder strap portion and the second shoulder strap portion of each shoulder strap capable of being coupled together by a fastening member when each shoulder strap being attached to the pair of torso bands;

a center strap being fixedly attached to the rear side of the pair of torso bands, the center strap having a connection loop with a locking member at a top end thereof;

a linearly extending safety strap having a first safety strap end capable of coupling with the locking member of the connection loop of the center strap, and a second safety strap end capable of being looped around a tree trunk, the second safety strap end having a locking member for coupling with a slip ring of the safety strap when positioned around the tree trunk;

a tension strap being fixedly attached to the safety strap and housed within a pouch, the tension strap capable of coupling with the slip ring positioned around the safety strap when the second end of the safety strap being looped around the tree trunk and coupled to the slip ring;

an elongated escape strap being fixedly attached to the safety strap and spaced from the first safety strap end, the escape strap being folded and positioned within a holder attached to the safety strap; and a jacket receiving the body harness when worn by a hunter using a tree stand, the jacket having a pair of shoulder flaps, a pair of under arm flaps and a pair of waist flaps, each of the flaps having one end fixedly attached to the jacket and another end with a snap-type fastener member, one of each of the shoulder flaps being capable of securing the first shoulder strap portion of the harness, the upper torso band being supported about the jacket with the pair of under arm flaps, the lower torso band being supported about the jacket with the pair of under arm flaps, the center strap of the harness being coupled to the safety strap looped around the tree trunk when the jacket being worn by the hunter to support the hunter in the invent of being separated from the tree stand.

2. A new and improved safety jacket and harness system comprising:

a body harness being formed by a pair of torso bands being fixedly attached to a pair of shoulder straps, the torso bands forming an upper torso band and a lower torso band, each torso band having a fastening member being attached to end portions thereof, the pair of shoulder straps each having a first shoulder strap portion and a second shoulder strap portion with each being coupled together by a fastening member when each shoulder strap being attached to the pair of torso bands;

a center strap being fixedly attached to the pair of torso bands and having a locking member at a top end;

a linearly extending safety strap having a first safety strap end capable of coupling with the locking member of the center strap, and a second safety strap end capable of being looped and fastened around a tree trunk;

an escape strap being attached to the safety strap; and a jacket receiving the body harness when worn by a hunter using a tree stand with the center strap of the harness being coupled to the safety strap looped around the tree trunk.

3. The safety jacket and harness system as set forth in claim 2, wherein the first shoulder strap portion of each shoulder strap being fixedly attached to a rear side of the upper torso band and looped over a rear side of the lower torso band for permanent attachment thereto, and the second shoulder strap portion of each shoulder strap being fixedly attached to a front side of the upper torso band and looped over a front side of the lower torso band for permanent attachment thereto.

4. The safety jacket and harness system as set forth in claim 3, wherein the center strap being attached to the rear side of the upper and lower torso band and the center strap having a connection loop at the top end for coupling with the locking member.

5. The safety jacket and harness system as set forth in claim 4, wherein the second safety strap end having a locking member for coupling with a slip ring of the safety strap when positioned around the tree trunk.

6. The safety jacket and harness system as set forth in claim 5, wherein the safety strap further including a tension strap, the tension strap being fixedly attached to the safety strap and housed within a pouch.

7. The safety jacket and harness system as set forth in claim 6, wherein the tension strap capable of coupling with the slip ring positioned around the safety strap when the second end of the safety strap being looped around the tree trunk and coupled to the slip ring.

8. The safety jacket and harness system as set forth in claim 6, wherein the escape strap being folded and positioned within a holder attached to the safety strap, the escape strap being spaced from the first safety strap end and the tension strap.

9. The safety jacket and harness system as set forth in claim 2, wherein the jacket having a pair of shoulder flaps, a pair of under arm flaps and a pair of waist flaps, and each of the flaps having one end fixedly attached to the jacket and another end with a snap-type fastener member.

10. The safety jacket and harness system as set forth in claim 9, wherein one of each of the shoulder flaps being capable of securing the first shoulder strap portion of the harness, the upper torso band being supported about the jacket with the pair of under arm flaps, the lower torso band being supported about the jacket with the pair of under arm flaps, whereby when the jacket being worn by the hunter with the harness coupled thereto the jacket and harness system is capable of supporting the hunter in the event of being separated from the tree stand.

* * * * *